US007090318B2

(12) United States Patent
Brown

(10) Patent No.: US 7,090,318 B2
(45) Date of Patent: Aug. 15, 2006

(54) SYSTEM FOR A SLIDING DOOR WITH A CAMBER

(75) Inventor: David Todd Brown, Winston-Salem, NC (US)

(73) Assignee: TCI Supply, Inc., Thomasville, NC (US)

( * ) Notice: Subject to any disclaimer, the term of this patent is extended or adjusted under 35 U.S.C. 154(b) by 0 days.

(21) Appl. No.: 10/304,558

(22) Filed: Nov. 26, 2002

(65) Prior Publication Data

US 2004/0100171 A1 May 27, 2004

(51) Int. Cl.
*A47B 88/00* (2006.01)

(52) U.S. Cl. ..... 312/332; 312/110; 312/322; 312/326

(58) Field of Classification Search ..... 312/322, 312/323, 326, 327, 329, 110, 7.2, 311, 312, 312/334.4, 334.5; 49/396; 16/362, 94 R, 16/95 R, 96 R See application file for complete search history.

(56) References Cited

U.S. PATENT DOCUMENTS

| | | | | | |
|---|---|---|---|---|---|
| 893,047 | A | * | 7/1908 | Rask | 49/5 |
| 1,146,673 | A | * | 7/1915 | Troth | 49/231 |
| 1,816,213 | A | * | 7/1931 | Duke | 312/294 |
| 1,920,855 | A | | 8/1933 | Gloekler | |
| 1,949,224 | A | | 2/1934 | Toelle | |
| 2,296,144 | A | * | 9/1942 | Harold | 49/260 |
| 4,073,034 | A | | 2/1978 | Martens | |
| D259,330 | S | | 5/1981 | Stine | |
| 4,519,655 | A | * | 5/1985 | Kamperman | 312/9.41 |
| 4,615,095 | A | * | 10/1986 | Bessinger et al. | 29/407.1 |
| 4,641,896 | A | * | 2/1987 | Iimura et al. | 312/110 |
| 4,729,612 | A | * | 3/1988 | Stone | 312/109 |
| 4,744,780 | A | * | 5/1988 | Volpe | 446/128 |
| 4,852,212 | A | | 8/1989 | Amann | 16/102 |
| 4,906,536 | A | * | 3/1990 | Simonton | 429/140 |
| 4,910,916 | A | | 3/1990 | Dubach et al. | 49/257 |
| 4,945,972 | A | | 8/1990 | Takeuchi | |
| 4,974,912 | A | * | 12/1990 | Rask et al. | 312/110 |
| 5,078,461 | A | | 1/1992 | Beck et al. | 312/331 |
| 5,108,161 | A | | 4/1992 | Rorke et al. | 312/322 |
| 5,121,817 | A | | 6/1992 | Garrido et al. | |
| 5,169,221 | A | | 12/1992 | Wheeler | |
| 5,395,165 | A | * | 3/1995 | Woerner | 312/110 |
| 5,399,010 | A | | 3/1995 | McClung et al. | 313/334 |
| 5,520,451 | A | | 5/1996 | Oshima | 312/322 |
| 5,537,796 | A | * | 7/1996 | Kliethermes, Jr. | 52/592.6 |

(Continued)

FOREIGN PATENT DOCUMENTS

GB 2143116 A * 2/1985

(Continued)

OTHER PUBLICATIONS

Information from Schock Metall; copyright 2001.

(Continued)

*Primary Examiner*—Peter M. Cuomo
*Assistant Examiner*—Sarah B. McPartlin
(74) *Attorney, Agent, or Firm*—Smith Moore LLP

(57) ABSTRACT

A slide assembly for use with a door of a furniture piece is disclosed. The slide assembly includes a pair of cambered slides and an alignment element. The pair of slides is for slidably mounting the door. The alignment element is for aligning the movement of the pair of slides. The camber is for compensating for the weight of the door to maintain the movement of the door substantially true relative to the furniture piece. Preferably, the pair of cambered slides is universally cambered. The universal camber is for permitting one design to be used without having to be concerned about the handedness of the cambered slide assembly.

109 Claims, 5 Drawing Sheets

U.S. PATENT DOCUMENTS

| | | | | |
|---|---|---|---|---|
| 5,597,218 | A * | 1/1997 | Lechman | 312/223.3 |
| D387,973 | S | 12/1997 | Layman | |
| 5,832,980 | A | 11/1998 | Cianciold | |
| 5,974,667 | A | 11/1999 | Bryson | |
| 5,984,442 | A | 11/1999 | Hellman, Jr. | |
| D422,884 | S | 4/2000 | Lafond | |
| 6,076,906 | A * | 6/2000 | Royal | 312/273 |
| 6,092,884 | A * | 7/2000 | Katz | 312/225 |
| 6,158,123 | A | 12/2000 | Bryson | 29/898.03 |
| 6,209,171 | B1 | 4/2001 | Pelletier et al. | 16/97 |
| 6,282,770 | B1 | 9/2001 | Lyon | 29/434 |
| 6,324,727 | B1 | 12/2001 | Ortoleva et al. | |
| 6,336,248 | B1 * | 1/2002 | Finkelstein et al. | 16/96 D |
| 6,435,635 | B1 * | 8/2002 | Lyon | 312/322 |
| D490,293 | S | 5/2004 | Brown | |
| 6,758,627 | B1 | 7/2004 | King | |
| 6,994,410 | B1 * | 2/2006 | Hogan | 312/322 |
| 2002/0081152 | A1 | 6/2002 | King | |
| 2002/0094235 | A1 | 7/2002 | King | |
| 2004/0100170 | A1 | 5/2004 | Brown | |
| 2004/0100171 | A1 | 5/2004 | Brown | |

FOREIGN PATENT DOCUMENTS

| | | |
|---|---|---|
| JP | 2003-038260 | 12/2003 |
| WO | WO 9004691 A1 * | 5/1990 |
| WO | WO 02/41458 | 5/2002 |

OTHER PUBLICATIONS

Copy of International Search Report for PCT/US03/37678.

Technical Drawing entitled "Follower Strip" and date stamped Nov. 6, 1996.

Jacqueline I. Kroschwitz, Concise Encyclopedia of Polymer Science and Engineering, encyclopedia, 1990, pp. 1311-1317, John Wiley & Sons, Inc., New York, NY.

Shock, Quality Pocket Door Slides for Both Wood and Metal Followers, article, 2001, pp. 1-3, International Division of Shock Metall GmbH, Urbach, Germany.

Rockler Companies, Inc., Glossary of Cabinet Hinge Terms, Copyright 1999, pp. 6, internet address: http://www.rockler.com/articles/display_article.cfm?&story_id= 38, Rockler Companies, Inc., Medina, MN.

HARDWARESOURCE, Inc., Hinge Glossary, Copyright 2002, pp. 6, internet address: http://www.hardwaresource.com/newsdetail.asp?ID=1, HardwareSource, Inc., San Diego, CA, USA.

Woodworker's Supply, Inc., Search results for Hardware Hinges/Concealed: #8 Quick$Crews® Truss Head Screws For Surface Mounted HARDWARE, Copyright 2000, pp. 8, internet address: http://woodworker.com/cgi—bin/SEARCH.exe?ADS=&SEARCH=concealed%20hinge&OLDINDEX=200501284283572100&JUMPTO=5&SHOWCOUNT=15&RESTRICTCATEGORY=on&RESTRICTBRAND=on&RESTRICTDESCRIPTION=on&RESTRICTHEADLINE=on&RESTRICTCOPY=on&SEARCHMODE=2&LC=112.002, Woodworker's Supply, Inc., Albuquerque, NM, USA.

Woodworker's Supply, Inc., Search results for Hardware Hinges/Concealed: Salice Rugged Salice Hinges Allow You Nearly Limitless Cabinet Door Design Options, Copyright 2000, pp. 4, internet address: http://woodworker.com/cgi—bin/SEARCH.exe?ADS=&SEARCH=concealed%20hinge&OLDINDEX=200501284283572100&JUMPTO=5&SHOWCOUNT=15&RESTRICTCATEGORY=on&RESTRICTBRAND=on&RESTRICTDESCRIPTION=on&RESTRICTHEADLINE=on&RESTRICTCOPY=on&SEARCHMODE=2&LC=112.002, Woodworker's Supply, Inc., Albuquerque, NM, USA.

Woodworker's Supply, Inc., Search results for Hardware Hinges/Concealed: You Can Get Full Access To Ple Cut Lazy Susans With Blum® Hinges, Copyright 2000, pp. 4, internet address: http://woodworker.com/cgi—bin/SEARCH.exe?ADS=&SEARCH=concealed%20hinge&OLDINDEX=200501284283572100&JUMPTO=5&SHOWCOUNT=15&RESTRICTCATEGORY=on&RESTRICTBRAND=on&RESTRICTDESCRIPTION=on&RESTRICTHEADLINE=on&RESTRICTCOPY=on&SEARCHMODE=2&LC=112.002, Woodworker's Supply, Inc., Albuquerque, NM, USA.

Woodworker's Supply, Inc., Search results for Hardware Hinges/Concealed: Concealed Hinges And Mounting Plates For Frameless Overlay Construction, Copyright 2000, pp. 2, Internet Address: http://woodworker.com/cgi—bin/SEARCH.exe?ADS=&SEARCH=concealed%20hinge&OLDINDEX=200501284283572100&JUMPTO=5&SHOWCOUNT=15&RESTRICTCATEGORY=on&RESTRICTBRAND=on&RESTRICTDESCRIPTION=on&RESTRICTHEADLINE=on&RESTRICTCOPY=on&SEARCHMODE=2&LC=112.002, Woodworker's Supply, Inc., Albuquerque, NM, USA.

Woodworker's Supply, Inc., Salice Concealed Hinges For Frameless Construction, Copyright 2000, pp. 7, internet address: http://woodworker.com/cgi-bin/FULLPRES.exe?PARTNUM=131—168&LARGEVIEW=ON, Woodworker's Supply, Inc., Albuquerque, NM, USA.

Woodworker's Supply, Inc., Matrix ⊱ Concealed Frame Hinges, Copyright 2000, pp. 2, internet address: http://woodworker.com/cgi-bin/FULLPRES.exe?PARTNUM=122—906&LARGEVIEW=ON, Woodworkers's Supply, Inc., Albuquerque, NM, USA.

Woodworker's Supply, Inc., Blum® Face Frame Hinges, Copyright 2000, pp. 3, Internet Address: http://woodworker.com/cgi-bin/FULLPRES.exe?PARTNUM=134—504&LARGEVIEW=ON, Woodworkers's Supply, Inc., Albuquerque, NM, USA.

Blum, Inc., Concealed Hinges: Function And Design For Perfect Motion, Copyright 2003, pp. 1-10 of 96, Internet Address: ftp://pdfwood:download@woodworker.com/1046_Concealed%20hinges.pdf, Blum, Inc., Stanley, NC.

Rockler Companies, Inc Flipper Door FAQ, Copyright 1999, pp. 4, internet address: http://www.rockler.com/articles/display_article.cfm?&story_id=34, Rockler Companies, Inc., Medina, MN.

Constantine's Wood Center Of Florida Inc., Accuride Pocket Door Slides: Detailed Description, Copyright 2004, p. 1, internet address: http://216.105.59.114/index.asp?PageAction=VIEWPROD&PRODID=830, Constantine's Wood Center of Florida Inc., Ft. Lauderdale, FL, USA.

* cited by examiner

SYSTEM FOR A SLIDING DOOR WITH A CAMBER

BACKGROUND OF THE INVENTION (1) Field of the Invention

The present invention relates generally to slide assemblies for use with a pocket door of a furniture piece and, more particularly, to cambered slide assemblies for preventing the doors from sagging and ensures smooth operation of the pocket doors.

(2) Description of the Prior Art

Some furniture pieces for use in the office and home have doors for closing open fronts. Typically, these doors are hinged at one side that is adjacent to the sidewall of the furniture piece and swing towards the front in an open position. Very often the hinge arrangement provides an open door that extends well beyond the furniture piece. Consequently, to eliminate the problem of the open door getting in the way when space may be limited, furniture pieces today are designed with pocket door assemblies. The pocket door assembly permits the doors to be slid out and closed. When in the open position the doors are slid back within the recess of the furniture piece opening thereby reducing space requirements for the furniture piece.

An example of a furniture piece is an entertainment center. Such centers have been getting larger with the advent of television sets that in recent years have been getting much bigger. In addition to the television sets, entertainment centers may accommodate VCR, CD, DVD players, stereo receivers, speakers and other electronic equipment that is generally found in an entertainment center.

The sliding pocket door has application, as well, in cabinets of all types, such as armoires, kitchen cabinets and other furniture items for use both in the office and home environment. These furniture pieces are generally finished furniture pieces with paint or varnished finishes.

Many different assembly mechanisms have been utilized in the past for the installation of pocket doors in furniture pieces. One is a cabinet with pocket doors in an assembly comprising a vertical carrier hingibly connecting a door and slidably mounted to upper and lower rails mounted to the cabinet sidewalls. After the door has been placed in the open position, it can be easily moved rearward with the carrier in the cabinet.

Another mechanism is a scissors mechanism mounted between the cabinet back wall and the rear edge of the door.

Yet another mechanism includes tracks mounted to the cabinet sidewall. A pair of pulleys is mounted below the rear portion of the upper track and above the front portion of the lower track. A cable is threaded around the pulleys with first and second ends attached to the door.

Another mechanism includes tracks containing a slide assembly with ball bearings between the slide assembly and an alignment element which is connected to the pair of slides within the track. The door is then affixed to the mounting plates on the slides and can move from the open to closed position and the closed to open position. Generally these assemblies are built to provide the appropriate installation distance for the slides. However, the weight of the door acting on the slide assembly causes the door to sag.

Arrangements for compensating for the sag of a door using a slide assembly are known in the art. However, these methods require a skilled installer to properly install the door in a proper position. It would be desirable to have an assembly that does not require skilled installers, especially on a furniture assembly line. In addition, it would be desirable to have a slide assembly that reduces the inventory that a manufacturer must maintain. Such a slide assembly would also be advantageous for use by the "do it yourselfers." That is, the ease of installation would make elaborate instructions regarding the appropriate installation of the slide assembly on the pair of doors unnecessary.

Thus, there remains a need for a new and improved slide assembly with a camber that is sufficient to compensate for any sag of the door regardless of door weight. Further, a slide assembly having a universal camber would be easy to install while at the same time not requiring elaborate installation instructions.

SUMMARY OF THE INVENTION

The present invention is directed to a slide assembly to support a door mounted in a furniture piece. The slide assembly includes a pair of cambered slides and an alignment element. The pair of slides is for slidably mounting the door. The alignment element is for aligning the movement of the pair of slides. The camber is for compensating for the weight of the door to maintain the movement of the door substantially true relative to the furniture piece. Preferably, the pair of cambered slides is universally cambered. The universal camber is for permitting one design to be used without having to be concerned about the handedness of the cambered slide assembly.

The furniture piece may be any one of fixed and movable. Examples of furniture pieces include a case good for providing interior storage space such as any one of a bookcase and a chest of drawers. Examples of fixed furniture pieces include a cabinet such as a kitchen cabinet. Other examples of furniture pieces include an armoire and an entertainment unit. The furniture piece may further include any one of framing and pilaster at an opening at which the door is both hingibly and slidably mounted.

Each slide of the pair of slides may be of a type that permits the door to be both hingibly and slidably mounted. One example of such a slide is a roller type slide. Another example of such a slide is a ball bearing type slide. A ball bearing type slide may include about 2 to 4 ball bearings per inch, preferably about 3 ball bearings per inch.

The slide assembly may further include a mounting plate or pair of mounting plates in contacting communication with each slide of the pair of slides. The slide assembly may further include an alignment element in contacting communication with each slide of the pair of slides. The alignment element may be as simple as a bar extending between the pair of slides. Such a bar may be any one of a flat stock and u-shaped channel and conceivably made of metal. The flat stock and u-shaped channel may be extruded. Preferably, the flat stock is extruded. Applicants have found that a flatness tolerance for the length of the alignment element of about 1/32 of an inch for up to and including about 120 inches, preferably, about 1/32 of an inch for up to and including about 240 inches to work well. The alignment element may be used to define the center-to-center distance between any one of a pair of hinges and the pair of slides.

The camber of the slide assembly is obtained by preselecting an offset in an attachment of each slide of the pair of slides at opposite ends of said alignment element. The preselected offset is determined by the weight of said door. The preselected offset is between about 0.005 to 0.02 inch. Such an offset creates a camber for the pair of slides of between about 0.005 to 0.02 inch/inch (between about 0.286 to 1.146 degrees).

The slide assembly may further include a pair of hinges for providing communication between the door and the slide assembly. The pair of hinges may be any one of a pair of high strength hinges and a pair of concealed hinges. The concealed hinges may be any one of concealed frameless hinges and concealed frame hinges. A specific example of concealed hinges is one of a geometric hinge. The slide assembly may be mounted so that the door has a horizontal pivot. Alternatively, the slide assembly may be mounted so that the door has a vertical pivot.

The sliding pocket door assembly further may include a hinge mounting plate. The hinge mounting plate may be any one of fixed and adjustable. The adjustable mounting plate may be slotted to provide for slidable adjustments.

The slide assembly may further include a spacer block for both hingibly and slidably mounting the door in a prescribed offset. The space is preferably a spacer block. The spacer block may be between about 0.5 and 2 inches thick. The material used for the space block is one that, among other things, may be receptive to accepting a fastener. To that end, the spacer block may be one of a wood and a polymer. Examples of some useful polymers include any one of an acrylonitrile butadiene styrene (ABS), a polyamide, a high density polyethylene (HDPE) and a high impact styrene). Preferred polymers include acrylonitrile butadiene styrene (ABS) and a polyamide.

The spacer is preferably a spacer block. Such a spacer block may further include a peripheral wall. Further, a support rib may be included within the peripheral wall. The support rib within the peripheral wall may be a plurality of support ribs. The spacer block further may include a thickened section in the peripheral wall. The thickened section in the peripheral wall may be a plurality of thickened sections. At locations of contacting communication between the peripheral wall and the support rib, the spacer block further may include rounded corners. Also at locations of contacting communication between any one of the peripheral wall and the plurality of support ribs and the plurality of support ribs wherein the spacer block further may include rounded corners. The spacer block further may includes pilot holes for accepting fasteners. Such pilot holes may be in one or more of the thickened section of the peripheral wall. The spacer may be manufactured by any appropriate means such as machining and the like. Injection molding appears to be a preferred manufacturing approach.

Accordingly, one aspect of the present invention is to provide a slide assembly for use in a furniture piece with a door. The slide assembly includes a pair of cambered slides and an alignment element. The pair of slides is for slidably mounting the door. The alignment element is for aligning the movement of the pair of slides. The camber is for compensating for the weight of the door to maintain the movement of the door substantially true relative to the furniture piece.

Another aspect of the present invention is to provide a slide assembly for use in a furniture piece with a door. The slide assembly includes a pair of universally cambered slides and an alignment element. The pair of slides is for slidably mounting the door. The alignment element is for aligning the movement of the pair of slides. The universal camber is for compensating for the weight of the door to maintain the movement of the door substantially true relative to the furniture piece while at the same time permitting one design to be used without having to be concerned about the handedness of the slide assembly.

Still another aspect of the present invention is to provide a slide assembly to support a door mounted in a furniture piece. The slide assembly includes a pair of universally cambered slides and an alignment element. The pair of slides is for slidably mounting the door. The alignment element is for aligning the movement of the pair of slides. The universal camber is for compensating for the weight of the door to maintain the movement of the door substantially true relative to the furniture piece while at the same time permitting one design to be used without having to be concerned about the handedness of the slide assembly.

These and other aspects of the present invention will become apparent to those skilled in the art after a reading of the following description of the preferred embodiment when considered with the drawings.

DESCRIPTION OF THE PREFERRED EMBODIMENTS

Figure 1:
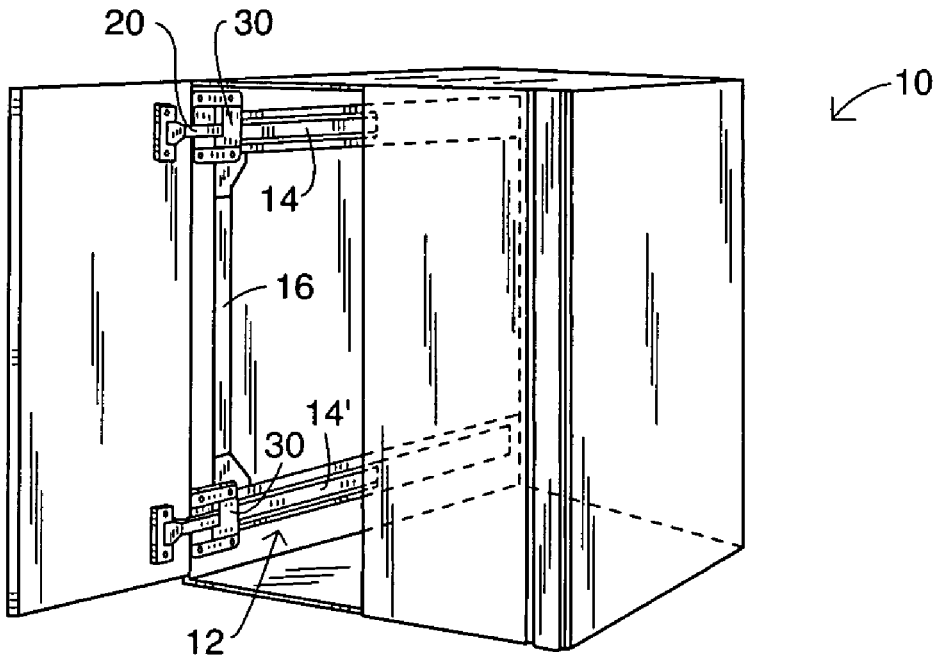
FIG. 1 is an isometric view of a furniture piece using a slide assembly according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1 there is shown a furniture piece 10, the slide assembly 12 and a door attached thereto. The furniture piece 10 depicted in FIG. 1 may be an entertainment center with pocket doors in the opening such as that for holding a television set.

Other types of furniture with pocket doors also may include a slide assembly 12. The furniture piece 10 may be any one of fixed and movable. Examples of furniture pieces 10 include a case good for providing interior storage space such as any one of a bookcase and a chest of drawers. Examples of fixed furniture pieces 10 include a cabinet such as a kitchen cabinet. Other examples of furniture pieces 10 include an armoire and an entertainment unit. The furniture piece 10 may further include any one of framing and pilaster at an opening at which the door is both hingibly and slidably mounted.

Figure 2A:
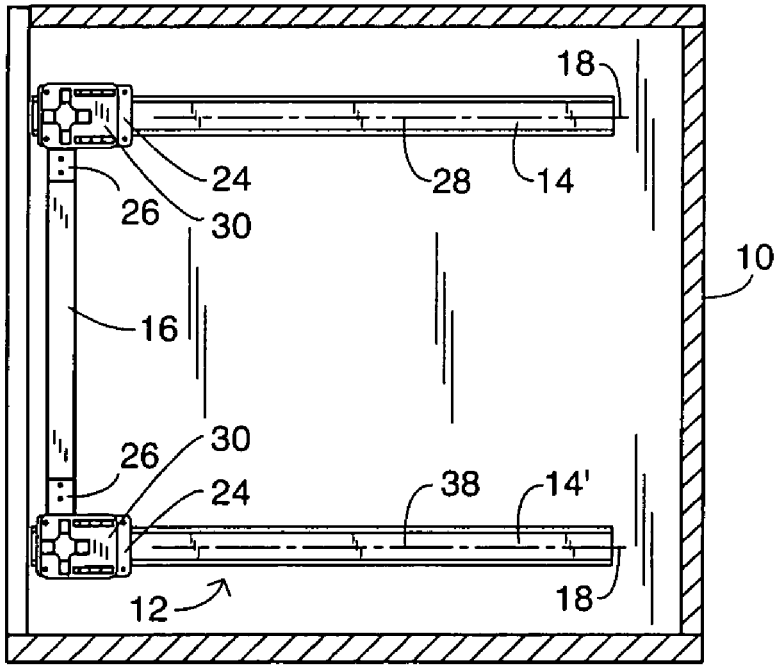
FIG. 2A (PRIOR ART)
FIG. 2A is a side view of an uncambered slide assembly.

FIG. 2A depicts an uncambered slide assembly 12 including a pair of uncambered slides 14 and an alignment element 16.

Figure 2B:
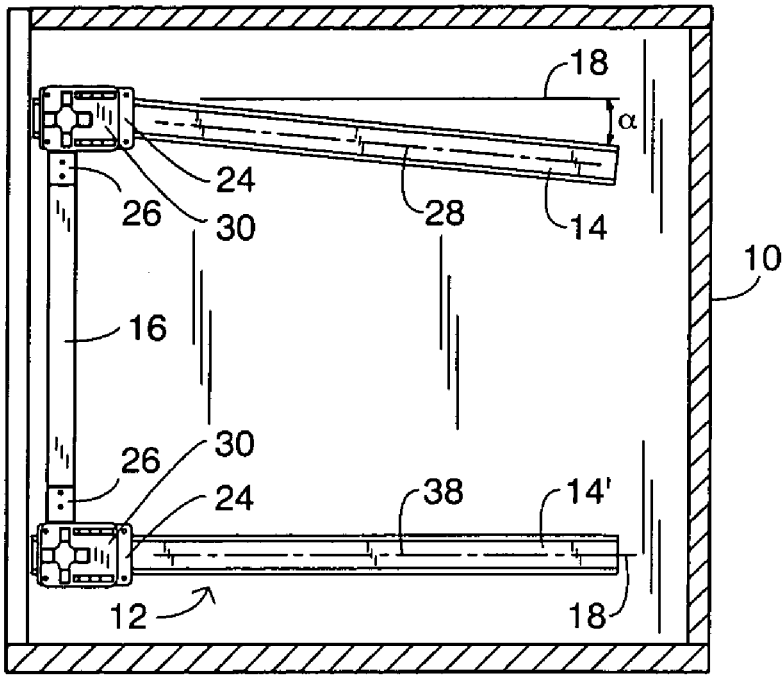
FIG. 2B is a side view of a single cambered slide assembly useable in the furniture piece of FIG. 1.

FIG. 2B depicts a cambered slide assembly 12 including a pair of cambered slides 14 and an alignment element 16. The pair of slides 14 is for slidably mounting the door. The alignment element 16 is for aligning the movement of the pair of slides 14. The pair of slides 14 is single cambered α. The camber α is for compensating for the weight of the door to maintain the movement of the door substantially true relative to the furniture piece. The single cambered a requires that the slide assembly 12 be manufactured in complementary pairs. Further, it is important to install the complementary pairs so that each slide assembly 12 has the slide 14 at the top of the door. Otherwise, rather than compensating for the weight of the door to maintain the movement of the door substantially true relative to the furniture piece 10, the camber α will exaggerate the sag in the door.

Figure 2C:
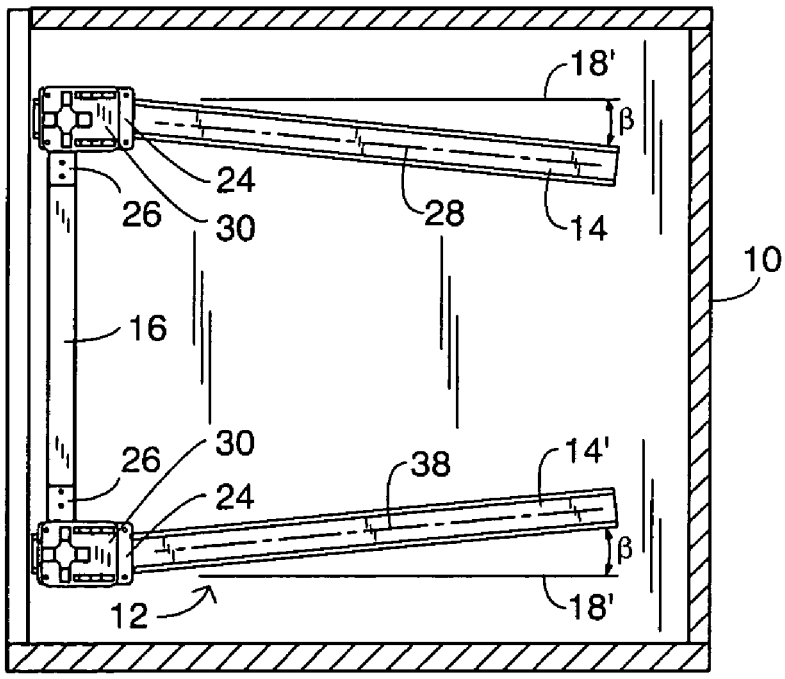
FIG. 2C is a side view of a universally cambered slide assembly useable in the furniture piece of FIG. 1.

FIG. 2C depicts the slide assembly 12 including a pair of cambered slides 14 and an alignment element 16. As with the single camber α, the pair of slides 14 is for slidably mounting the door. The alignment element 16 is for aligning the movement of the pair of slides 14. The pair of cambered slides 14 are preferably universally cambered β. The universal camber β is for compensating for the weight of the door to maintain the movement of the door substantially true relative to the furniture piece. The universal camber β is for permitting one design of the slide assembly 12 to be used without having to be concerned about the handedness of the cambered slide assembly.

In FIG. 2B the top slide 14 has a longitudinal axis 28 and the bottom slide 14' has a longitudinal axis 38. In an uncambered slide assembly 12 (FIG. 2A), longitudinal axis 28 of the top slide 14 and the longitudinal axis 38 of the bottom slide 14' are substantially parallel. In the uncambered slide assembly 12, the door sags because of its weight.

In a single camber α slide assembly 12, the line 18 in FIG. 2B represents a line substantially parallel to the longitudinal axis 38 of the bottom slides 14'. Corresponding to line 18 is an angle "α" that represents the amount that the longitudinal axis 28 deviates from line 18. Another way of describing the angle "α" is that it is a measure of the amount that the longitudinal axis 38 of the top slide 14 deviates from a line that is substantially perpendicular to the longitudinal axis of the alignment member 16.

In FIG. 2C, the universal camber β is illustrated to have two corresponding angle "β" with respect to a lines 18' that are substantially perpendicular with alignment member 16. Another way of describing the angle "β" is that it is a measure of the amount that the longitudinal axis 28 of the top slide 14 deviates from a line 18' that is substantially perpendicular to the longitudinal axis of the alignment member 16. Also, the angle "β" is a measure of the amount that the longitudinal axis 38 of the bottom slide 14' deviates from a line 18' that is substantially perpendicular to the longitudinal axis of the alignment member 16. The table below summarizes the camber offset for the single camber α and the universal camber β. As indicated, the amount of camber is a function of the weight of the door that is to be supported by the slide assembly 12.

| | Single Camber α | | Universal Camber β | | |
|---|---|---|---|---|---|
| Door Weight (lbs) | Camber Offset (in/in) | Camber Angle "α" (degress) | Camber Offset (in/in) | Camber Half Angle "β" (degrees) | Camber Angle (degrees) |
| Up to 5 | 0.005 | 0.286 | 0.002 to 0.003 | 0.115 to 0.172 | 0.229 to 0.344 |
| Greater than 5 and up to 15 | 0.010 | 0.573 | 0.004 to 0.006 | 0.229 to 0.344 | 0.458 to 0.607 |
| Greater than 15 and up to 25 | 0.015 | 0.859 | 0.007 to 0.008 | 0.401 to 0.458 | 0.802 to 0.917 |
| Greater than 25 | 0.020 | 1.146 | 0.009 to 0.013 | 0.516 to 0.745 | 1.031 to 1.489 |

Applicant has found that offsetting the alignment of holes for attaching the alignment member 16 to the pair of slides 14 may set the amount of the camber. In the example illustrated in FIG. 2A, pairs of fasteners 26 are shown in mounting plate 24. There is a corresponding hole in the alignment member 16. For the uncambered slide assembly 12, the hole in the mounting member 24 falls on a line substantially perpendicular to the longitudinal axes 28 & 38. Likewise, the corresponding holes at either end of the alignment member 16 fall on a line substantially parallel to the longitudinal axis of the alignment member 16.

In the example illustrated in FIG. 2B for the single camber α, the corresponding holes at the bottom end of the alignment member 16 fall on a line substantially parallel to the longitudinal axis of the alignment member 16. However, the corresponding holes at top end of the alignment member 16 do not fall on a line substantially parallel to the longitudinal axis of the alignment member 16. If the upper hole falls on a line substantially parallel to the longitudinal axis of the alignment member 16 then the lower hole is offset just to the left of the a line. Alternatively, if the lower hole falls on a line substantially parallel to the longitudinal axis of the alignment member 16 then the upper hole is offset just to the right of the line.

In a universal camber β slide assembly 12, the lines 18' in FIG. 2C represent lines that are substantially parallel and from which longitudinal axis 28 of the top slide 14 and longitudinal axis 38 of the bottom slides 14' deviate. Corresponding to each line 18' is an angle "β" that represents the amount that the longitudinal axes 28 & 38 deviated from lines 18'. Another way of describing the angle "β" is that it is a measure of the amount that the longitudinal axes 28 & 38 of the pair of slides 14 deviate from a line 18' that is substantially perpendicular to the longitudinal axis of the alignment member 16. In FIG. 2C the universal camber β is illustrated to have a corresponding angle "β" with respect to a line that is substantially perpendicular with alignment member 16.

This camber α & β treatment as depicted in FIGS. 2B &2C allow the pair of slides 14 of the slide assembly 12 to operate smoothly when loaded with the weight of a door in a furniture piece 10. That is, when the doors are open there is a moment acting on the slide assembly 12 as a result of extending the outer edge of the door. The camber treatment of the pair of slides 14 compensates for moment and permits smooth sliding of the door on the pair of slides 14 without sagging as the doors are moved back and forth along the pair of slides 14. The camber α & β may prevent catching or grinding on the slides. The single camber α may vary from anywhere from about 0.005 to 0.02 inch/inch (between about 0.286 to 1.146 degrees). The universal camber β may vary from anywhere from about 0.002 to 0.013 inch/inch (between about 0.115 to 0.516 degrees) for a total of from about 0.004 to 0.026 inch/inch (between about 0.229 to 1.489 degrees). In the preferred embodiment, the camber α & β is created by attaching the alignment element 16 in a slightly off-center position in relation to the slides 14. This off-center position is accomplished by placing the attachment hole slightly off-center on the alignment element 16. The weight of the door determines the distance the hole is off-center within about 0.002 to 0.026 inch. In the preferred embodiment, a camber is placed in the top and bottom of the alignment element 16. This universal camber β treatment facilitates ease of installation of the slide assembly during the furniture fabrication process or for the "do it yourselfer" working at home. The installer does not need complicated instructions to determine the top or bottom of the slide assembly 12 or whether the slide assembly 12 should go on the right or left hand door. Because the preferred embodiment contains a camber β at both ends of the alignment element 16, there is essentially no wrong way to install the slide assembly 12 for proper fit and operation.

Figure 2D:
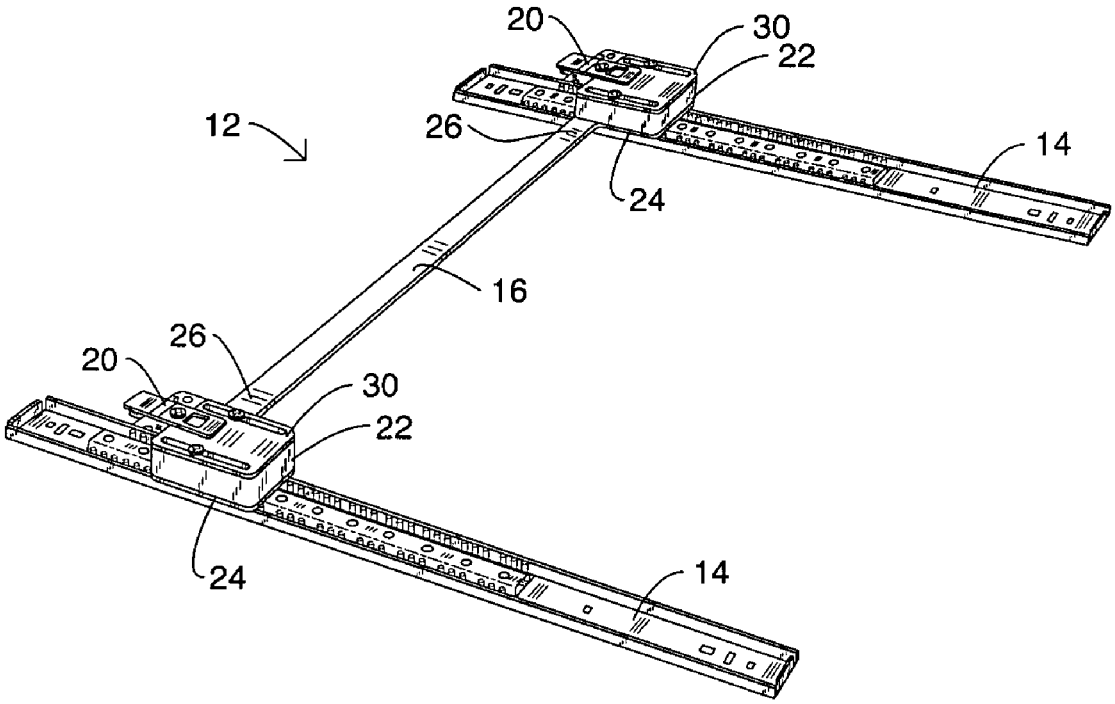
FIG. 2D is an isometric view of a slide assembly useable in the furniture piece of FIG. 1.

FIG. 2D depicts the cambered slide assembly 12 that includes a pair of slides 14, an alignment element 16 and a spacer 22 that, preferably, is a spacer block. The pair of slides 14 is for slidably mounting the door to the furniture piece. The alignment element 16 is for aligning the movement of the pair of slides 14. The spacer 22, which preferably is a spacer block, is for setting off the door to permit the door to be both hingibly and slidably mounted to the furniture piece 10 having any one of a frame and a pilaster. The spacer 22 may include other alternatives such as those disclosed in U.S. Pat. Nos. 6,435,635 and 6,282,770, the disclosure of each being herein incorporated by reference in their entirety.

Each slide of the pair of slides 14 may be of a type that permits the door to be both hingibly and slidably mounted. One example of such a slide is a roller type slide. Another example of such a slide is ball bearing type slide. A ball bearing type slide may include about 2 to 4 ball bearings per inch, preferably about 3 ball bearings per inch.

Figure 3:
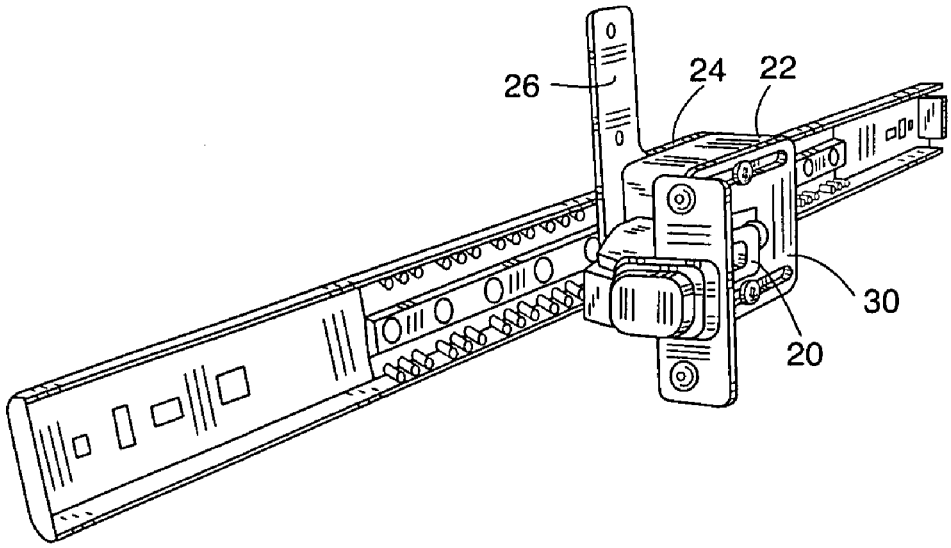
FIG. 3 is an isometric view of a slide useable in the furniture piece of FIG. 1 and the slide assembly of FIGS. 2B, 2C & 2D.
Figure 4:
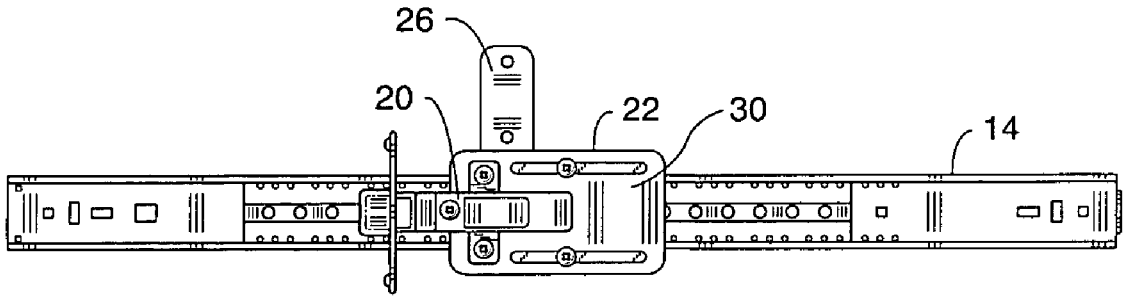
FIG. 4 is a frontal view of the slide of FIG. 3.

FIGS. 2B, 2C & 2D depict a pair of slides 14 and FIGS. 3 & 4 depict a slide from a pair of slides 14. Also depicted in FIGS. 2B, 2C, 2D, 3 & 4 is a mounting plate 24 for tying the movement of the pair of slides 14 together through the alignment element 16. Another function of mounting plate 24 is to provide a means for fastening a spacer 22 to each slide of the pair of slides 14.

The alignment element 16 is constructed to facilitate the concerted movement of the pair of slides 14. Any structure that accomplishes that function will be appropriate for use as the alignment element 16. Those skilled in the art will recognize such structures. One such structure is a bar that spans between the pair of slides 14. Such a bar may be any one of flat stock and u-shaped channel and conceivably made of metal. The flat stock and u-shaped channel may be extruded. Preferably, the flat stock is extruded. Applicant has found that a flatness tolerance for the length of the alignment element of about 1/32 of an inch for up to and including about 120 inches, preferably, about 1/32 of an inch for up to and including about 240 inches to work well. Also, the alignment element 16 may be used to define the center-to-center distance between any one of a pair of hinges 20 and the pair of slides 14.

Again, FIGS. 2B, 2C, 2D, 3 & 4 depict hinges 20 of slide assembly 12. Each hinge 20 of the pair of hinges may be any one of a pair of high strength hinges and a pair of concealed hinges. The concealed hinges may be any one of concealed frameless hinges and concealed frame hinges. A specific example of concealed hinges is one of a geometric hinge (such hinges are available, for example, from Salice America Inc. of Charlotte, N.C. and Amerock Corporation of Rockford, Ill.). The slide assembly 12 may be mounted so that the door has a horizontal pivot. Alternatively, the slide assembly may be mounted so that the door has a vertical pivot.

The sliding pocket door assembly further may include a hinge mounting plate 30. The hinge mounting plate 30 may be any one of fixed and adjustable. The adjustable mounting plate 30 may be slotted to provide for slidable adjustments. The hinge mounting plate 30 may be affixed, either directly or with the spacer block 22 interposed, to the slides 14 before the hinge 20 is installed. The hinge mounting plate 30 may be a fixed plate or an adjustable mounting plate. In the preferred embodiment, the hinge mounting plate 30 is an adjustable mounting plate. The mounting plate 30 is slotted to facilitate the finishing of the furniture piece 10 and for the final adjustment of the door. Concerning the finishing of the furniture piece 10, the slots in the mounting plate 30 allow the door to be extended beyond the face of the front. In this manner, the back of the door is accessible for finishing. Another advantage of the slots in the mounting plate 30 is that they allow the hardware to be used with doors that over lay the face (e.g., the pilaster or frame) of the furniture piece 10. Concerning the final adjustment of the door, the slots in the mounting plate 30 also allow minute slidable distance adjustments to ensure fit of the hinge 20. The adjustable mounting plate 30 is attached to the spacer block 22. Aspects of the adjustable mounting plate 30 are disclosed in U.S. Pat. Nos. 6,435,635 and 6,282,770, the disclosure of each being herein incorporated by reference in their entirety.

Figure 5A:
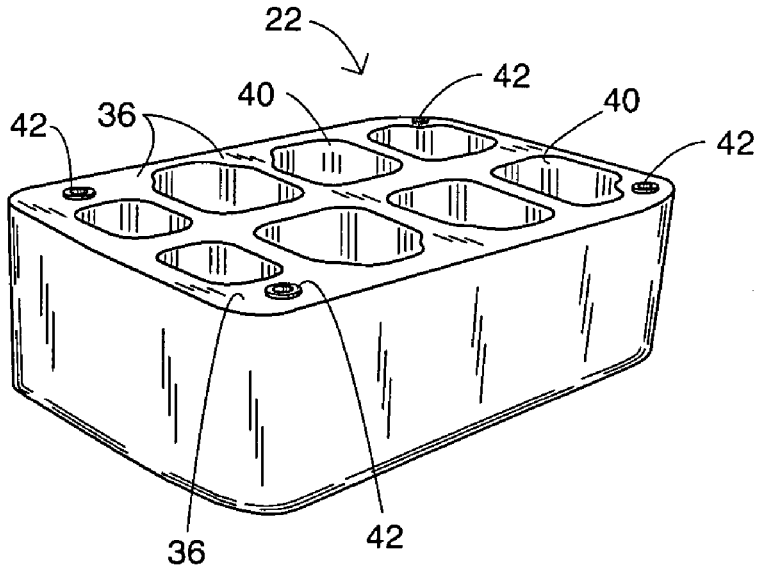
FIG. 5A is an isometric view of a spacer block useable in the furniture piece of FIG. 1, the slide assembly of FIGS. 2B, 2C, & 2D and the slide of FIGS. 3 & 4.
Figure 5B:
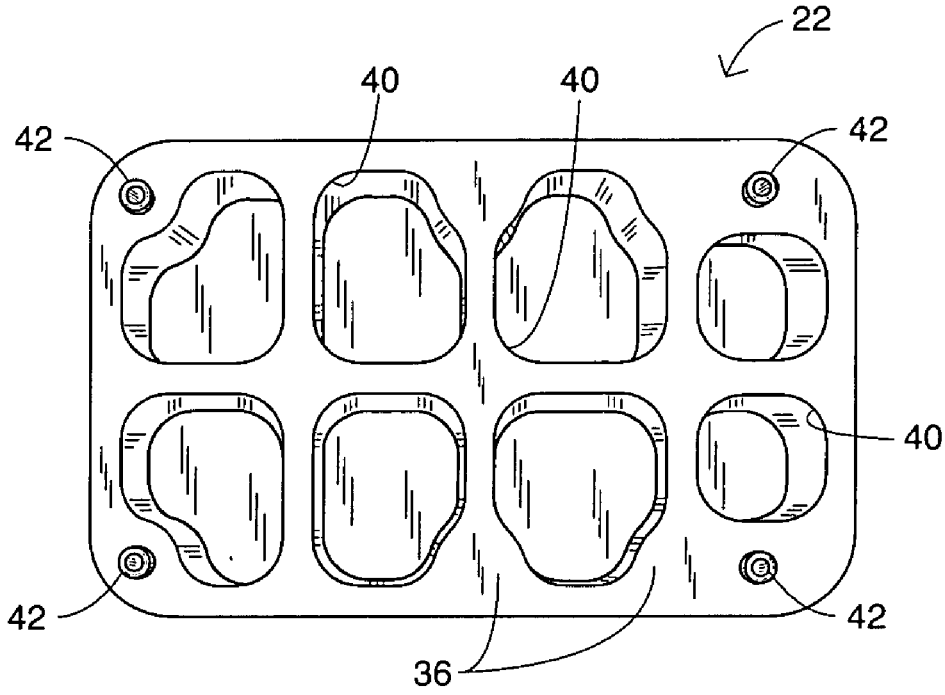
FIG. 5B is a bottom view of the spacer block of FIG. 5A.
Figure 5C:
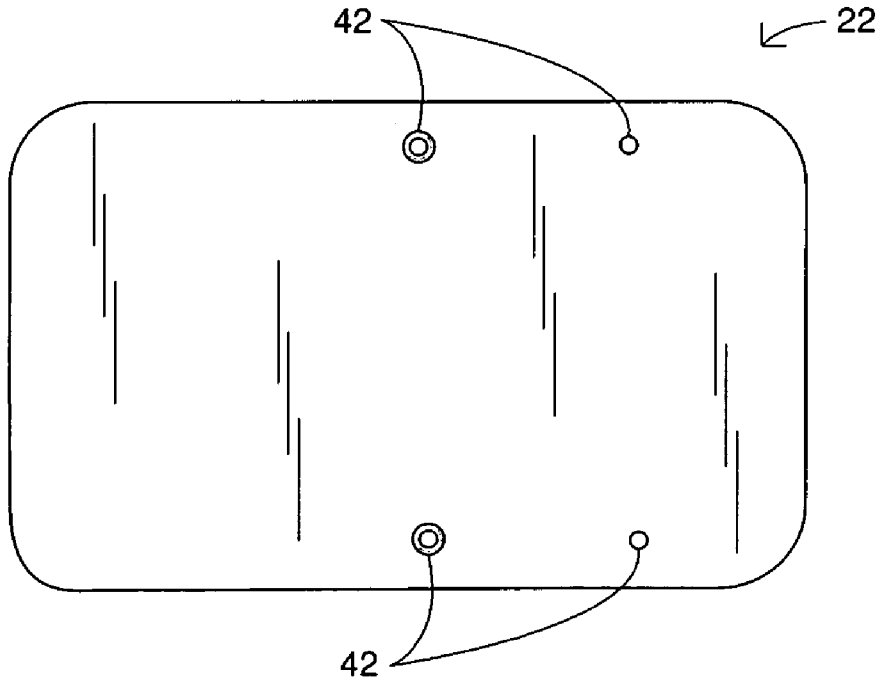
FIG. 5C is top view of the spacer block of FIGS. 5A & 5B.

FIGS. 5A, 5B & 5C depict the spacer 22. The space 22 is preferably a spacer block 22 that may be between about 0.5 and 2 inches thick. The material used for the space block 22 is one that, among other things, may be receptive to accepting a fastener. To that end, the spacer block may be one of a wood and a polymer. Examples of some useful polymers include any one of an acrylonitrile butadiene styrene (ABS), a polyamide, a high density polyethylene (HDPE) and a high impact styrene). Preferred polymers include acrylonitrile butadiene styrene (ABS) and a polyamide.

Referring again to FIGS. 5A, 5B & 5C that depict the spacer block 22 further includes a peripheral wall 32. Further, a support rib 34 may be included within the peripheral wall 32 that may be a plurality of support ribs. The spacer block 22 further may include a thickened section 36 in the peripheral wall 32 that may be a plurality of thickened sections. At locations of contacting communication between the peripheral wall 32 and the support rib 34, the spacer block 22 further may include rounded corners 40. Also at locations of contacting communication between any one of the peripheral wall 32 and the plurality of support ribs 34 and the plurality of support ribs 34 include rounded corners 40. The honeycombed effect created by the support ribs 34 provides increased strength and yet also provides for a spacer block 22 which is much lighter than a solid block of injected molded polymer and cheaper to construct. The spacer block 22 also includes pilot holes 42. The spacer block 22 further may include pilot holes 42 for accepting fasteners. Such pilot holes 42 maybe in one or more of the thickened section 36 of the peripheral wall 32. These pilot holes 42 are used to mount spacer blocks 22 to the pair of slides 14. There are also pilot holes 42 to mount the hinges 20 to the spacer block 22.

The spacer 22 may be manufactured by any appropriate means such as machining and the like. Injection molding appears to be a preferred manufacturing approach. Use of the spacer block 22 permits the incorporation of the slide assembly 12 in face framing or pilaster installation applications.

The design of the injected molded polymer spacer block is such that once installed it provides an extremely stable platform that does not rock or give. This rigidity permits the doors to move smoothly and effortlessly along the slides 14 without binding or catching or sagging.

Certain modifications and improvements will occur to those skilled in the art upon a reading of the foregoing description. By way of example, the alignment member 16, rather than being a piece of any one of an extruded flat stock and u-shaped channel, it may be a piece of roller stock having flanges that make the rolled stock stiff thereby maintaining the flatness of the alignment member 16. It should be understood that all such modifications and improvements have been deleted herein for the sake of conciseness and readability but are properly within the scope of the following claims.

I claim:

1. A slide assembly for use in a furniture piece with a door, said slide assembly comprising:

(a) a pair of slides for slidably mounting the door;

(b) an alignment element for aligning the movement of said pair of slides; and (c) a universal camber for compensating for the weight of the door to maintain the movement of the door substantially true relative to the furniture piece, wherein the universal camber is formed by the pair of slides being angled towards each other.

2. The slide assembly according to claim 1, further including at least one furniture piece wherein said slide assembly is mounted in said at least one furniture piece.

3. The slide assembly according to claim 2, wherein said at least one furniture piece is any one of fixed and movable.

4. The slide assembly according to claim 3, wherein said at least one furniture piece is fixed.

5. The slide assembly according to claim 4, wherein said cabinet is a kitchen cabinet.

6. The slide assembly according to claim 2, wherein said at least one furniture piece is a case good for providing interior storage space.

7. The slide assembly according to claim 6, wherein said case good includes any one of a bookcase and a chest of drawers.

8. The slide assembly according to claim 3, wherein said fixed piece of furniture is a cabinet.

9. The slide assembly according to claim 2, wherein said at least one furniture piece is an armoire.

10. The slide assembly according to claim 2, wherein said at least one furniture piece is an entertainment unit.

11. The slide assembly according to claim 2, wherein said at least one furniture piece further includes framing at an opening at which the door is both hingibly and slidably mounted.

12. The slide assembly according to claim 2, wherein said at least one furniture piece further includes a pilaster at an opening at which the door is both hingibly and slidably mounted.

13. The slide assembly according to claim 1, wherein each slide of said pair of slides is a roller type slide.

14. The slide assembly according to claim 1, wherein each slide of said pair of slides is a ball bearing type slide.

15. The slide assembly according to claim 14, wherein said ball bearing slide includes about 2 to 4 ball bearings per inch.

16. The slide assembly according to claim 14, wherein said ball bearing slide includes about 3 ball bearings per inch.

17. The slide assembly according to claim 1, further including a mounting plate in contacting communication with each slide of said pair of slides.

18. The slide assembly according to claim 1, further including an alignment element coupling in contacting communication with each slide of said pair of slides.

19. The slide assembly according to claim 1, wherein said alignment element is a bar extending between said pair of slides.

20. The slide assembly according to claim 19, wherein said bar has a flatness tolerance of about 1/32 of an inch for up to and including about 120 inches.

21. The slide assembly according to claim 19, wherein said bar is metal.

22. The slide assembly according to claim 19, wherein said bar is any one of a flat stock and a u-shaped channel.

23. The slide assembly according to claim 22, wherein said flat stock is extruded.

24. The slide assembly according to claim 1, wherein said alignment element defines the center-to-center distance between said pair of slides.

25. The slide assembly according to claim 1, wherein a preselected offset of an attachment of said alignment element at opposite ends of said alignment element to each of said pair of slides creates said camber.

26. The slide assembly of claim 25, wherein said preselected offset of said attachment of said alignment element to each of said pair of slides is determined by the weight of said door.

27. The slide assembly according to claim 25, wherein said preselected offset is between about 0.002 to 0.026 inch/inch.

28. The slide assembly according to claim 1, further including a pair of hinges for providing communication between the door and said slide assembly.

29. The slide assembly according to claim 28, wherein said alignment element defines the center-to-center distance between said pair of hinges.

30. The slide assembly according to claim 28, wherein said pair of hinges is a pair of high strength hinges.

31. The slide assembly according to claim 28, wherein said pair of hinges is a pair of concealed hinges.

32. The slide assembly according to claim 31, wherein said pair of hinges is a pair of concealed frameless hinges.

33. The slide assembly according to claim 32, wherein said concealed hinge is one of a geometric hinge.

34. The slide assembly according to claim 31, wherein said concealed hinge is one of a concealed frame hinge.

35. The slide assembly according to claim 28, wherein said slide assembly is mounted so that the door has a horizontal pivot.

36. The slide assembly according to claim 28, wherein said slide assembly is mounted so that the door has a vertical pivot.

37. The slide assembly according to claim 1, wherein said slide assembly further includes a hinge mounting plate.

38. The slide assembly according to claim 37, wherein said hinge mounting plate is fixed.

39. The slide assembly according to claim 37, wherein said hinge mounting plate is adjustable.

40. The slide assembly according to claim 39, wherein said adjustable mounting plate is slotted to provide for slidable adjustments.

41. The slide assembly according to claim 1, further including a spacer block for said slide assembly for both hingibly and slidably mounting a door, said spacer block permitting said slides to be directly mounted to door end panels.

42. The slide assembly according to claim 41, wherein said spacer block is between about 0.5 and 2 inches thick.

43. The slide assembly according to claim 41, wherein said spacer block is one of a wood and a polymer.

44. The slide assembly according to claim 43, wherein said spacer block is injection molded.

45. The slide assembly according to claim 43, wherein said spacer block is a polymer comprising an acrylonitrile butadiene styrene (ABS).

46. The slide assembly according to claim 43, wherein said spacer block is a polymer comprising a polyamide.

47. The slide assembly according to claim 43, wherein said spacer block is a polymer comprising one of an acrylonitrile butadiene styrene (ABS), a polyamide, a high density polyethylene (HDPE), and a high impact styrene.

48. The slide assembly according to claim 41, wherein said spacer block further includes a peripheral wall.

49. The slide assembly according to claim 48, wherein said spacer block further includes a thickened section in the peripheral wall.

50. The slide assembly according to claim 49, wherein said thickened section in the peripheral wall is a plurality of thickened sections.

51. The slide assembly according to claim 41, wherein said spacer block further includes a support rib within the peripheral wall.

52. The slide assembly according to claim 51, wherein said support rib within the peripheral wall is a plurality of support ribs.

53. The slide assembly according to claim 52, wherein said spacer block further includes rounded corners at locations of contacting communication between any one of said peripheral wall and said plurality of support ribs.

54. The slide assembly according to claim 51, wherein said spacer block further includes rounded corners at locations of contacting communication between said peripheral wall and said support rib.

55. The slide assembly according to claim 41, wherein said spacer block further includes pilot holes for accepting fasteners.

56. A furniture piece with at least one door and a slide assembly, said slide assembly comprising:

(a) a pair of slides for slidably mounting the door;

(b) an alignment element for aligning the movement of said pair of slides; and (c) an universal camber for compensating for the weight of the door to maintain the movement of the door substantially true relative to the furniture piece, wherein said slide assembly is mounted in said furniture piece, wherein the universal camber is formed by the pair of slides being angled towards each other.

57. The furniture piece according to claim 56, wherein said furniture piece is any one of fixed and movable.

58. The furniture piece according to claim 57, wherein said furniture piece is fixed.

59. The furniture piece according to claim 58, wherein said fixed piece of furniture is a cabinet.

60. The furniture piece according to claim 59, wherein said cabinet is a kitchen cabinet.

61. The slide assembly according to claim 56, wherein said furniture piece is a case good for providing interior storage space.

62. The furniture piece according to claim 61, wherein said case good includes any one of a bookcase and a chest of drawers.

63. The furniture piece according to claim 56, wherein said furniture piece is an armoire.

64. The furniture piece according to claim 56, wherein said furniture piece is an entertainment unit.

65. The furniture piece according to claim 56, wherein said furniture piece further includes framing at an opening at which the door is both hingibly and slidably mounted.

66. The furniture piece according to claim 56, wherein said furniture piece further includes a pilaster at an opening at which the door is both hingibly and slidably mounted.

67. The furniture piece according to claim 56, wherein each slide of said pair of slides is a roller type slide.

68. The furniture piece according to claim 56, wherein each slide of said pair of slides is a ball bearing type slide.

69. The furniture piece according to claim 68, wherein said ball bearing slide includes about 2 to 4 ball bearings per inch.

70. The furniture piece according to claim 68, wherein said ball bearing slide includes about 3 ball bearings per inch.

71. The furniture piece according to claim 56, further including a mounting plate in contacting communication with each slide of said pair of slides.

72. The furniture piece according to claim 56, further including an alignment element coupling in contacting communication with each slide of said pair of slides.

73. The furniture piece according to claim 56, wherein said alignment element is a bar extending between said pair of slides.

74. The furniture piece according to claim 73, wherein said bar is any one of a flat stock and a u-shaped channel.

75. The apparatus furniture piece according to claim 74, wherein said flat stock is extruded.

76. The furniture piece according to claim 73, wherein said bar is metal.

77. The furniture piece according to claim 73, wherein said bar has a flatness tolerance of about 1/32 of an inch for up to and including about 120 inches.

78. The furniture piece according to claim 56, wherein said alignment element defines the center-to-center distance between said pair of slides.

79. The furniture piece according to claim 56, wherein a preselected offset of an attachment of said alignment element at opposite ends of said alignment element to each of said pair of slides creates said camber.

80. The furniture piece of claim 79, wherein said preselected offset of said attachment of said alignment element to each of said pair of slides is determined by the weight of said door.

81. The furniture piece according to claim 79, wherein said preselected offset is between about 0.002 to 0.026 inch/inch.

82. The slide assembly according to claim 56, further including a pair of hinges for providing communication between the door and said slide assembly.

83. The furniture piece according to claim 82, wherein said alignment element defines the center-to-center distance between said pair of hinges.

84. The furniture piece according to claim 82, wherein said pair of hinges is a pair of high strength hinges.

85. The furniture piece according to claim 82, wherein said pair of hinges is a pair of concealed hinges.

86. The apparatus furniture piece according to claim 85, wherein said pair of hinges is a pair of concealed frameless hinges.

87. The furniture piece according to claim 85, wherein said concealed hinge is one of a concealed frame hinge.

88. The furniture piece according to claim 86, wherein said concealed hinge is one of a geometric hinge.

89. The furniture piece according to claim 82, wherein said slide assembly is mounted so that the door has a horizontal pivot.

90. The furniture piece according to claim 82, wherein said slide assembly is mounted so that the door has a vertical pivot.

91. The furniture piece according to claim 56, wherein said slide assembly further includes a hinge mounting plate.

92. The furniture piece according to claim 91, wherein said hinge mounting plate is fixed.

93. The furniture piece according to claim 91, wherein said hinge mounting plate is adjustable.

94. The furniture piece according to claim 93, wherein said adjustable mounting plate is slotted to provide for slidable adjustments.

95. The furniture piece according to claim 56, further including a spacer block for said slide assembly for both hingibly and slidably mounting a door, said spacer block permitting said slides to be directly mounted to door end panels.

96. The furniture piece according to claim 95, wherein said spacer block is between about 0.5 and 2 inches thick.

97. The furniture piece according to claim 95, wherein said spacer block is one of a wood and a polymer.

98. The slide assembly according to claim 97, wherein said spacer block is a polymer comprising one of an acrylonitrile butadiene styrene (ABS), a polyamide, a high density polyethylene (HDPE) and a high impact styrene.

99. The furniture piece according to claim 97, wherein said spacer block is a polymer comprising a polyamide.

100. The furniture piece according to claim 97, wherein said spacer block is a polymer comprising an acrylonitrile butadiene styrene (ABS).

101. The furniture piece according to claim 97, wherein said spacer block is injection molded.

102. The furniture piece according to claim 95, wherein said spacer block further includes a peripheral wall.

103. The furniture piece according to claim 102, wherein said spacer block further includes a thickened section in the peripheral wall.

104. The furniture piece according to claim 103, wherein said thickened section in the peripheral wall is a plurality of thickened sections.

105. The furniture piece according to claim 103, wherein said spacer block further includes pilot holes for accepting fasteners.

106. The furniture piece according to claim 95, wherein said spacer block further includes a support rib within the peripheral wall.

107. The furniture piece according to claim 106, wherein said support rib within the peripheral wall is a plurality of support ribs.

108. The furniture piece according to claim 107, wherein said spacer block further includes rounded corners at locations of contacting communication between any one of said peripheral wall and said plurality of support ribs.

109. The furniture piece according to claim 106, wherein said spacer block further includes rounded corners at locations of contacting communication between said peripheral wall and said support rib.

* * * * *

UNITED STATES PATENT AND TRADEMARK OFFICE

CERTIFICATE OF CORRECTION

PATENT NO. : 7,090,318 B2
APPLICATION NO. : 10/304558
DATED : August 15, 2006
INVENTOR(S) : David Todd Brown It is certified that error appears in the above-identified patent and that said Letters Patent is hereby corrected as shown below:

Column 5, line 8, after "cambered," "a" should be replaced by --α--.

Signed and Sealed this

Thirty-first Day of October, 2006

JON W. DUDAS
*Director of the United States Patent and Trademark Office*